US009681762B2

(12) United States Patent
Peng

(10) Patent No.: US 9,681,762 B2
(45) Date of Patent: Jun. 20, 2017

(54) DECORATIVE FRAME

(71) Applicant: HANGZHOU LEGGY HORSE TECH.CO., LTD., Hangzhou (CN)

(72) Inventor: Yalan Peng, Hangzhou (CN)

( * ) Notice: Subject to any disclaimer, the term of this patent is extended or adjusted under 35 U.S.C. 154(b) by 0 days.

(21) Appl. No.: 15/011,572

(22) Filed: Jan. 31, 2016

(65) Prior Publication Data

US 2016/0143460 A1 May 26, 2016

Related U.S. Application Data

(63) Continuation of application No. PCT/CN2014/083711, filed on Aug. 5, 2014.

(30) Foreign Application Priority Data

Aug. 8, 2013 (CN) ..... 2013 1 0343785

(51) Int. Cl.
*A47G 1/06* (2006.01)
*A47G 1/14* (2006.01)

(52) U.S. Cl.
CPC ..... *A47G 1/0611* (2013.01); *A47G 1/065* (2013.01); *A47G 1/142* (2013.01)

(58) Field of Classification Search
CPC ... G09F 1/12; G09F 7/18; G09F 15/02; A47G 1/142; A47G 1/0611
USPC ..... 40/790, 764, 761, 752, 753
See application file for complete search history.

(56) References Cited

U.S. PATENT DOCUMENTS 2,224,586 A * 12/1940 Abbott ..... G09F 1/14 248/473
2,413,669 A * 12/1946 Whitcombe ..... F16B 37/045 411/85
2,993,290 A * 7/1961 Bell ..... G09F 1/12 40/791
3,548,523 A * 12/1970 Laws ..... G09F 1/14 40/658
3,665,628 A * 5/1972 Dammond ..... G09F 1/12 40/790
3,914,892 A * 10/1975 Mohr ..... G09F 1/12 24/67.3

(Continued)

*Primary Examiner* — Shin Kim
(74) *Attorney, Agent, or Firm* — Wayne & Ken, LLC; Tony C. Hom

(57) ABSTRACT

A decorative frame comprises a lining plate (1), wherein a layer of tensioned elastic film (2) is covered at one side of the lining plate (1); the edge of the elastic film (2) is fixed at the edge of the lining plate (1) by virtue of clipping strips (3); an interlayer is formed between the lining plate (1) and the elastic film (2); an inserting opening (4) is left at the edge of the lining plate (1) and the elastic film (2); the lining plate (1) or/and the elastic film (2) is/are transparent; paintings and photos can be inserted into or taken out of the interlayer by uncovering the elastic film (2), thereby facilitating the operation; the paintings, the photos and the like in the interlayer can be saw through the lining plate (1) or/and the elastic film (2); a support component (6) is assembled on the clipping strips (3); and the angle adjustment of the decorative frame is realized by adjusting the position of the landing leg (62) of the support component (6), thereby overcoming the technical problems of inconvenient replacement of the paintings and the photos and unfavorable transport in the existing decorative frame.

17 Claims, 6 Drawing Sheets

(56) References Cited

U.S. PATENT DOCUMENTS 3,924,307 A * 12/1975 Tate ..... A47G 1/0638 24/490
3,936,968 A * 2/1976 Gilbert ..... A47G 1/08 248/488
4,187,630 A * 2/1980 Giulie ..... G09F 1/12 40/757
4,216,936 A * 8/1980 DeSelms ..... A47G 1/142 248/460
4,250,640 A * 2/1981 Culhane ..... A47G 1/06 40/537
4,282,668 A * 8/1981 Jolkovski ..... A47G 1/0638 248/488
4,310,976 A * 1/1982 Wilten ..... G09F 1/12 40/661
4,356,647 A * 11/1982 Farris ..... G09F 15/02 40/661
4,877,213 A * 10/1989 Lambert ..... A47B 97/08 248/451
5,038,503 A * 8/1991 Goldberg ..... B42F 7/14 40/777
5,040,318 A * 8/1991 Ryan ..... B42D 1/08 40/396
5,082,230 A * 1/1992 Chang ..... A47G 1/24 248/279.1
5,101,586 A * 4/1992 Zennedjian ..... A47G 1/0605 40/761
D343,065 S * 1/1994 Barbieri ..... D6/310
5,722,623 A * 3/1998 Gibson ..... G09F 3/204 248/201
5,815,971 A * 10/1998 Rothe ..... G09F 15/0018 40/718
5,832,646 A * 11/1998 Albin ..... A47G 1/142 40/757
6,435,466 B1 * 8/2002 Adams ..... A47B 23/044 248/455
6,508,451 B1 * 1/2003 Blythe ..... F16M 13/00 248/351
7,296,373 B1 * 11/2007 Hahn ..... G09F 15/0012 40/617
7,322,139 B2 * 1/2008 Holcomb ..... G09F 1/14 248/469
7,802,390 B2 * 9/2010 Reis ..... A47G 1/0605 40/711
7,823,311 B2 * 11/2010 Pitcher ..... G09F 7/10 40/618
7,954,267 B2 * 6/2011 Anzalone ..... G09F 7/18 40/611.06
2001/0018784 A1 * 9/2001 Pitcher ..... B42F 15/066 24/200
2001/0045042 A1 * 11/2001 Dowzall ..... A47G 1/0611 40/790
2005/0235541 A1 * 10/2005 Weatherill ..... G09F 15/0068 40/771
2007/0209261 A1 * 9/2007 Stover ..... G09F 7/18 40/617
2014/0150314 A1 * 6/2014 Herz ..... A47G 1/06 40/790
2015/0266329 A1 * 9/2015 Kelly ..... G09F 3/08 40/124.191
2016/0143460 A1 * 5/2016 Peng ..... A47G 1/0611 40/790

* cited by examiner

DECORATIVE FRAME

CROSS-REFERENCE TO RELATED APPLICATIONS

This application is a continuation of International Patent Application No. PCT/CN2014/083711 with an international filing date of Aug. 5, 2014, designating the United States, now pending, and further claims priority benefits to Chinese Patent Applications No. 201310343785.8, filed Aug. 8, 2013. The contents of all of the aforementioned applications, including any intervening amendments thereto, are incorporated herein by reference.

TECHNICAL FIELD

The present invention belongs to a decorative frame which is used for exhibiting paintings, photos and the like.

BACKGROUND

Most of the existing decorative frames (such as photo frames and exhibition frames) are frame structures, which are complicated in structures, and need to be disassembled when paintings and photos are placed; therefore, the decorative frames are used inconveniently; and most of decorative frames without frame are fixed structures, but the paintings and the photos are replaced inconveniently; and in addition, an angle of the decorative frame cannot be adjusted by virtue of a support of the existing decorative frame.

SUMMARY OF THE PRESENT INVENTION

The technical problems to be solved by the present invention and the technical task to be proposed by the present invention are to overcome the defect that the decorative frame in the prior art is inconvenient for replacing the paintings and the photos by providing a decorative frame convenient for replacing the paintings and the photos, thereby, facilitating the adjustment of the angle of the decorative frame.

In order to achieve the above purposes, the decorative frame of the present invention comprises a lining plate, and is characterized in that: a layer of tensioned elastic film is covered at one side of the lining plate, an interlayer is formed between the lining plate and the elastic film, an inserting opening of the interlayer is left at the edge of the lining plate and the elastic film, and the lining plate or/and the elastic film is/are transparent.

As a preferred technical means, the edge of the elastic film is fixed at the edge of the lining plate by virtue of clipping strips, so that the part that the elastic film is located between the clipping strips is tensioned.

As a preferred technical means, the edge of the elastic film is covered at the edge of the lining plate, entrapped at the edge of the lining plate by the clipping strips, and spliced or welded with the lining plate and the clipping strips.

As a preferred technical means, each clipping strip comprises an internal insertion strip and an external insertion strip, the edge of the elastic film is extruded between the internal insertion strip and the external insertion strip, and the internal insertion strip is clamped at the edge of the lining plate.

As a preferred technical means, the external insertion strip is provided with an inserting groove, the internal insertion strip is provided with a convex rib, the edge of the elastic film is wound on the convex rib of the internal insertion strip, the convex rib of the internal insertion strip is embedded in the inserting groove of the external insertion strip, and the edge of the elastic film is extruded between the internal insertion strip and the external insertion strip.

As a preferred technical means, the decorative frame comprises a standby clipping strip which is clamped at the edge of the lining plate that the clipping strips are not assembled.

As a preferred technical means, the decorative frame comprises a support component; the support component comprises a retaining strip and a landing leg; the retaining strip is assembled on the clipping strips; at least two gears are arranged on the retaining strip; and the landing leg is assembled on one gear of the retaining strip.

As a preferred technical means, a track with a guiding convex rib is arranged on the back of the retaining strip; the gear is a bump distributed on the track; a gap is arranged at the end of the landing leg; and a guide groove matched with the guiding convex rib and a locating groove matched with the bump are arranged in the gap.

As a preferred technical means, the assembly mode of the retaining strip and the clipping strips is one of clamping, insertion and fastener connection or a combination of at least two modes.

As a preferred technical means, the clipping strips are of structures having two parallel sides and forming a clamping slot between the two sides, and the edge of the lining plate is located in the clamping slot, thereby realizing the clamping of the clipping strips and the lining plate. Further, the mouth of the clamping slot is open.

As a preferred technical means, an uncovering part is arranged at the edge of the inserting opening where the elastic film is located.

As a preferred technical means, the uncovering part is a gap or an extension part exceeding the edge of the lining plate or a pulling part corresponding to the gap on the edge of the lining plate.

As a preferred technical means, the elastic film is a TPU film; and the lining plate is one of an acrylic plate, a glass plate and a plastic plate.

The decorative frame has the beneficial effects that: in an assembly state, the paintings and photos can be inserted into or taken out of the interlayer by uncovering the elastic film, thereby facilitating the operation; and in addition, the angle adjustment of the decorative frame is realized by adjusting the position of the landing leg of the support component.

Figure 1:
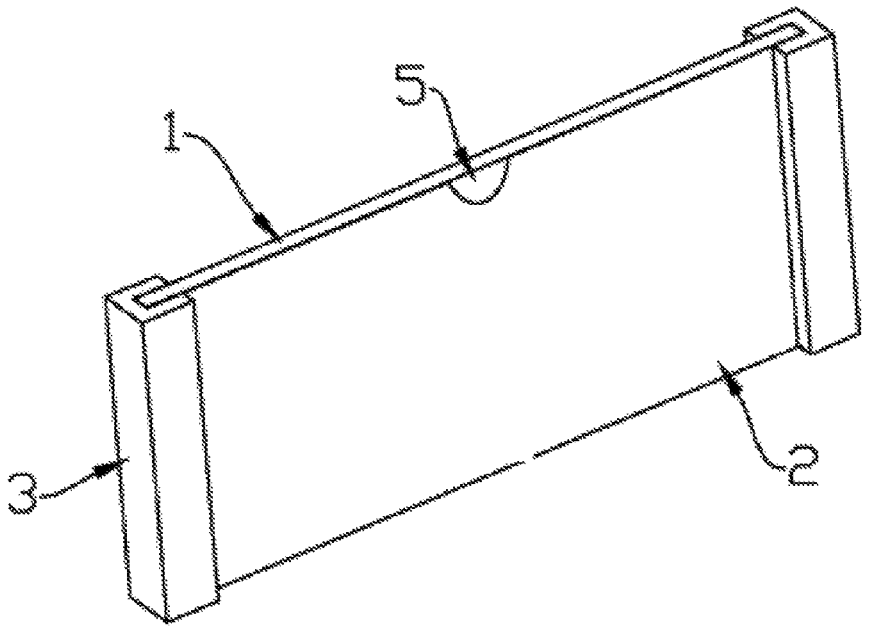
FIG. 1 is a structural diagram of the present invention.
Figure 2:
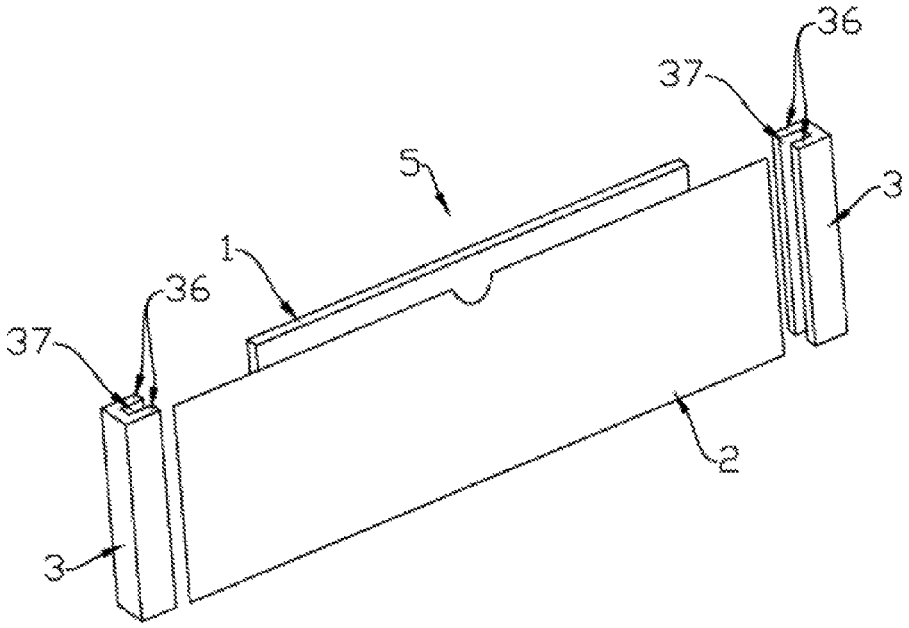
FIG. 2 is a decomposition diagram of the structure shown in FIG. 1.
Figure 3:
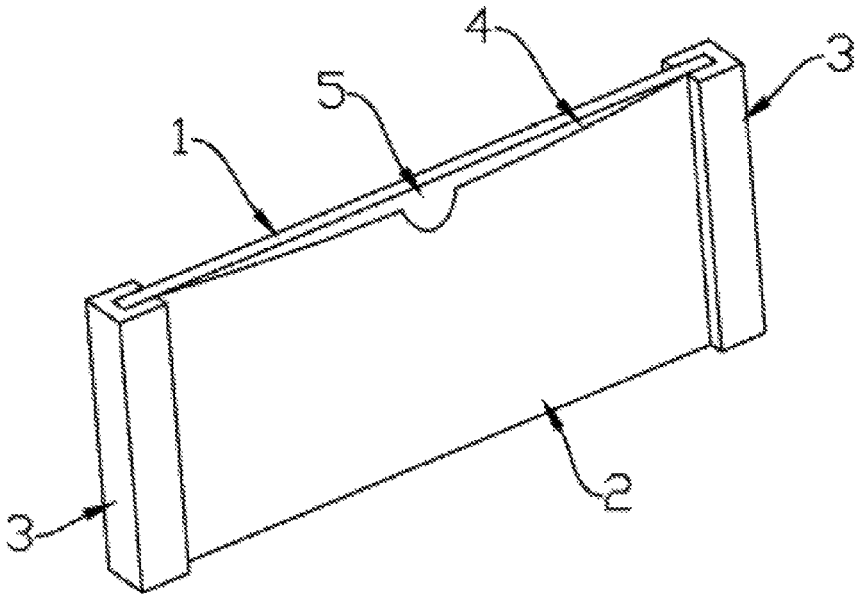
FIG. 3 is a diagram when an elastic film of a decorative frame shown in FIG. 1 is uncovered.
Figure 4:
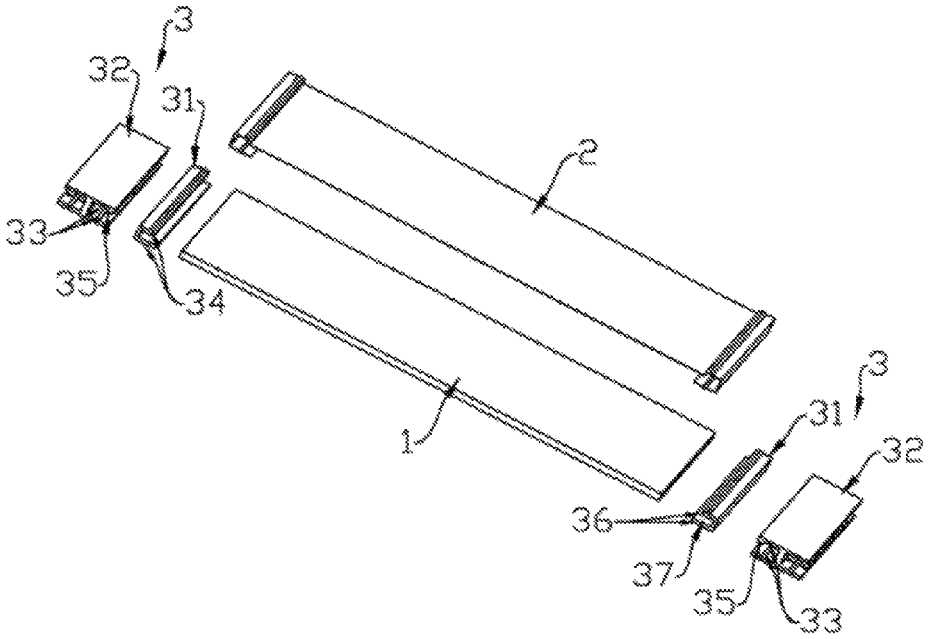
FIG. 4 is a decomposition diagram of another structure of the present invention.

In which, label declaration is as follows: 1—lining plate, 2—elastic film, 3—clipping strips, 31—internal insertion strip, 32—external insertion strip, 33—inserting groove, 34—convex rib, 35—stopping side, 36—side, 37—clamping slot, 38—opening, 4—inserting opening, 5—uncovering part, 6—support component, 61—retaining strip, 62—landing leg, 63—gear, 64—track, 65—guiding convex rib, 66—gap, 67—connecting plug, and 68—clamping convex rib.

DETAILED DESCRIPTION OF EMBODIMENTS

Further description is made for the present invention in combination with the drawings of the description.

The decorative frame of the present invention, as shown in FIGS. 1-4, comprises a lining plate 1, wherein a layer of tensioned elastic film 2 is covered at one side of the lining plate 1, an interlayer is formed between the lining plate 1 and the elastic film 2, an inserting opening 4 of the interlayer is left at the edge of the lining plate 1 and the elastic film 2, the lining plate 1 or/and the elastic film 2 is/are transparent, and the paintings, photos and others are inserted into the interlayer between the lining plate 1 and the elastic film 2 through the inserting opening, so that the paintings, the photos and others in the interlayer can be saw through the lining plate 1 or/and the elastic film 2; and further treatment, such as flocking and the like, can be carried out on the lining plate 1 or the elastic film 2 on the premise that the paintings and the photos in the interlayer can be saw according to the situations.

As the further improvement and supplement of the above technical solution, the present invention further comprises additional technical features involved in paragraphs below. FIGS. 1-3 and FIG. 4 contain all additional technical features below and are the better embodiment of the present invention, but the present invention is not limited to the situation. Therefore, FIGS. 1-3 and FIG. 4 can be selected for the technical solution in the previous paragraph according to the specific effect when implementing the present invention.

Firstly, the edge of the elastic film 2 is fixed at the edge of the lining plate 1 by virtue of the clipping strips 3, so that the part that the elastic film 2 is located between the clipping strips 3 is tensioned. In the specific implementation, two ways can be provided to fix the edge of the elastic film 2 at the edge of the lining plate 1 by virtue of the clipping strips 3:

One way is (see FIGS. 1-3): the edge of the elastic film 2 is covered at the edge of the lining plate 1, entrapped at the edge of the lining plate 1 by the clipping strips, and spliced or welded with the lining plate 1 and the clipping strips 3 (such as ultrasonic welding).

The other way is (see FIG. 4): each clipping strip 1 comprises an internal insertion strip 31 and an external insertion strip 32, the edge of the elastic film 2 is extruded between the internal insertion strip 31 and the external insertion strip 32, and the internal insertion strip 31 is clamped at the edge of the lining plate 1. Further, the external insertion strip 32 is provided with an inserting groove 33, the internal insertion strip 31 is provided with a convex rib 34, the edge of the elastic film 2 is wound on the convex rib 34 of the internal insertion strip 31, the convex rib 34 of the internal insertion strip 31 is embedded in the inserting groove 33 of the external insertion strip 32, and the edge of the elastic film 2 is extruded between the internal insertion strip 31 and the external insertion strip 32. This structure is convenient for users to assemble: the edge of the elastic film 2 is fixed on the two clipping strips, the elastic film 2 is tensioned by the two clipping strips, and the two clipping strips are clamped at the edge of the lining plate.

Secondly, the decorative frame comprises a standby clipping strip which is clamped at the edge of the lining plate 1 that the clipping strips are not assembled. The standby clipping strip is used for entrapping another two parallel sides after the paintings and the photos are placed insides and carrying out the moisture protection on placed products, thereby effectively isolating the influence of dryness and humidity change outside the frame on works in the frame.

Figure 5:
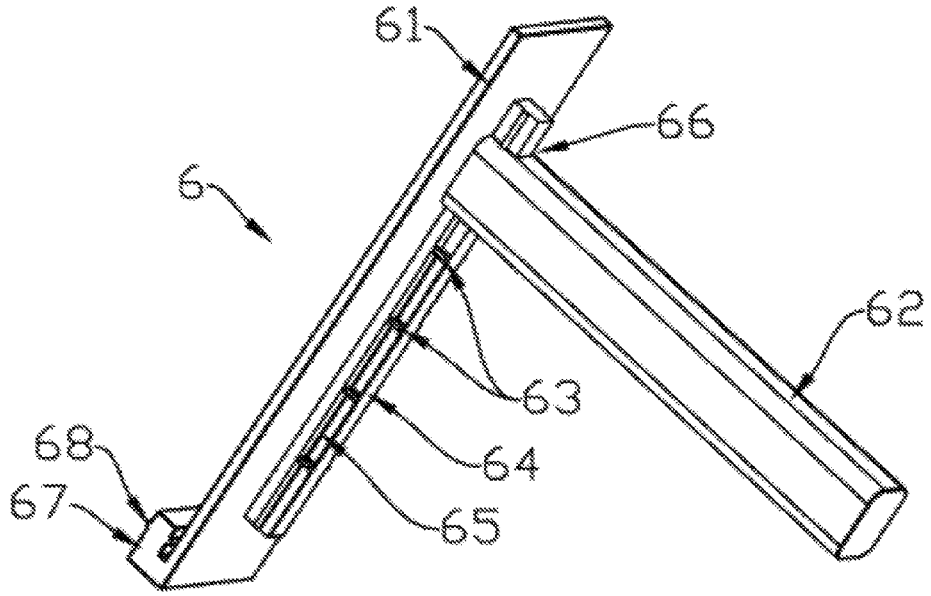
FIG. 5 is a structural diagram of a support component of the present invention.

Thirdly, the decorative frame comprises a support component 6. See FIG. 5. The support component 6 comprises a retaining strip 61 and a landing leg 62, the retaining strip 61 is assembled on the clipping strips 3, at least two gears 63 are arranged on the retaining strip 61, and the landing leg 62 is assembled on one gear of the retaining strip 61. Further, a track 64 with a guiding convex rib 65 is arranged on the back of the retaining strip 61, the gear 63 is a bump distributed on the track 64, a gap 66 is arranged at the end of the landing leg 62, a guide groove matched with the guiding convex rib 65 and a locating groove matched with the bump are arranged in the gap 66, and the angle adjustment of the decorative frame is realized by adjusting the position of the landing leg on the retaining strip. The assembly mode of the retaining strip 61 and the clipping strips 3 is one of clamping, insertion and fastener connection or a combination of at least two modes (FIG. 5 shows a structural style that a connecting plug 67 is arranged at the lower end of the retaining strip 61 and a clamping convex rib 68 is arranged on the connecting plug, and correspondingly, a corresponding slot for fixing the connecting plug is arranged on the clipping strips); and apparently, the retaining strip 61 can also be assembled with the standby clipping strip, thereby realizing the angle adjustment of the decorative frame.

Figure 6:
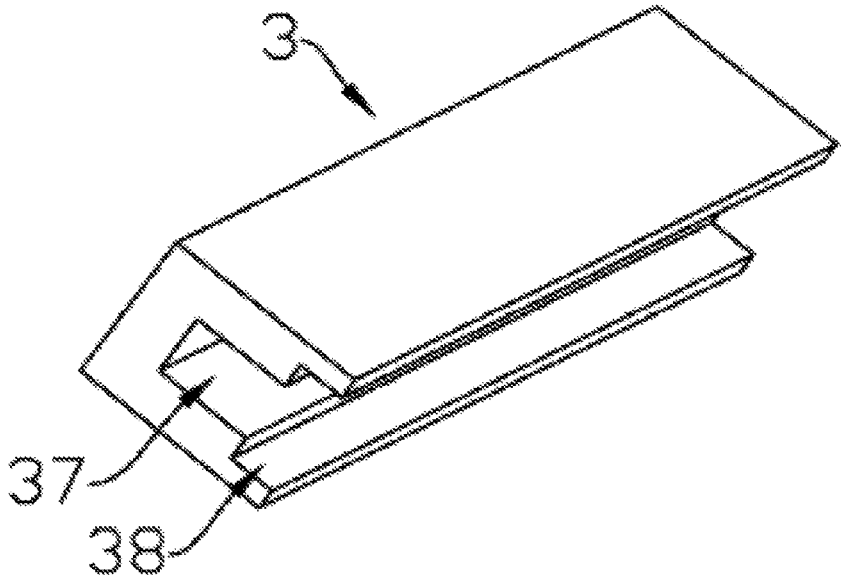
FIG. 6 is a structural diagram of a clipping strip of the present invention.

Fourthly, the clipping strips are of structures having two parallel sides 36 and forming a clamping slot 37 between the two sides 36, and the edge of the lining plate 1 is located in the clamping slot 37, thereby realizing the clamping of the clipping strips and the lining plate. Further, with reference to FIG. 6, the mouth of the clamping slot 37 is open (e.g., formed by installing steps inside the two sides), therefore, the edge of the lining plate 1 is easily inserted into the clamping slot 37.

Fifthly, an uncovering part 5 is arranged at the edge of the inserting opening that the elastic film 2 is located, so as to open the inserting opening to put in or take out the paintings; and specifically, the uncovering part 5 is a gap or an extension part exceeding the edge of the lining plate 1 or a pulling part corresponding to the gap on the edge of the lining plate 1.

Sixthly, the elastic film 2 is a TUP film; and the lining plate 1 is one of an acrylic plate, a glass plate and a plastic plate.

I claim:

1. A decorative frame, comprising a lining plate (1), characterized in that: a layer of tensioned elastic film (2) is covered at one side of the lining plate (I), an interlayer is formed between the lining plate (1) and the elastic film (2), an inserting opening (4) of the interlayer is left at an edge of the lining plate (1) and the elastic film (2), and the lining plate (1) or/and the elastic film (2) is/are transparent;

wherein the decorative frame further comprises a support component (6); the support component (6) comprises a retaining strip (61) and a landing leg (62); the retaining strip (61) is assembled on clipping strips (3); at least two gears (63) are arranged on the retaining strip (61); and the landing leg (62) is assembled on one gear of the retaining strip (61); and an edge of the elastic film (2) is fixed at the edge of the lining plate (1) by virtue of the clipping strips (3), so that the part that the elastic film (2) is located between the clipping strips (3) is tensioned.

2. The decorative frame according to claim 1, characterized in that: the edge of the elastic film (2) is covered at the edge of the lining plate (1), entrapped at the edge of the lining plate (1) by the clipping strips (2), and spliced or welded with the lining plate (1) and the clipping strips (3).

3. The decorative frame according to claim 1, characterized in that each clipping strip (3) comprises an internal insertion strip (31) and an external insertion strip (32), the edge of the elastic film (2) is extruded between the internal insertion strip (31) and the external insertion strip (32), and the internal insertion strip (31) is clamped at the edge of the lining plate (1).

4. The decorative frame according to claim 3, characterized in that the external insertion strip (32) is provided with an inserting groove (33), the internal insertion strip (31) is provided with a convex rib, the edge of the elastic film (2) is wound on the convex rib (34) of the internal insertion strip, the convex rib (34) of the internal insertion strip is embedded in the inserting groove (33) of the external insertion strip, and the edge of the elastic film (2) is extruded between the internal insertion strip and the external insertion strip.

5. The decorative frame according to claim 3, characterized in that: a stopping, side (35) for preventing the convex rib (34) from dropping out of the inserting groove (33) is arranged on the external insertion strip (32).

6. The decorative frame according to claim 1, characterized in that: the decorative frame comprises a standby clipping strip which is clamped at the edge of the lining plate that the clipping strips (3) are not assembled.

7. The decorative frame according to claim 1, characterized in that: a track (64) with a guiding convex rib (65) is arranged on the back of the retaining snip (61); the gear (63) is a hump distributed on the track (64); a gap (66) is arranged at the end of the landing leg (62); and a guide groove matched with the guiding convex rib (65) and a locating groove matched with the hump are arranged in the gap (66).

8. The decorative frame according, to claim 1, characterized in that: the assembly mode of the retaining strip (61) and the clipping strips (3) is one of clamping, insertion and fastener connection or a combination of at least two modes.

9. The decorative frame according to claim 1, characterized in that: the clipping strips (3) are of structures having two parallel sides (36) and forming a clamping slot (37) between the two sides (36), and the edge of the lining plate (1) is located in the clamping slot (37), thereby realizing the clamping of the clipping strips and the lining plate.

10. The decorative frame according to claim 9, characterized in that: a mouth of the clamping slot (37) is open.

11. Pie decorative frame according to claim 1, characterized in that: an uncovering part (5) is arranged at the edge of the inserting opening (4) where the elastic film (2) is located.

12. The decorative frame according to claim 11, characterized in that: the uncovering part (5) is a gap or an extension part exceeding the edge of the lining plate (1) or a pulling, part corresponding to the gap on the edge of the lining plate (1).

13. The decorative frame according to claim 1, characterized in that: the elastic film (2) is a TPU film; and the lining plate (I) is one of an acrylic plate, a glass plate and a plastic plate.

14. The decorative frame according to claim 2, characterized in that: the clipping strips (3) are of structures having two parallel sides (36) and forming a clamping slot (37) between the two sides (36), and the edge of the lining plate (1) is located in the clamping slot (37), thereby realizing the clamping of the clipping strips and the lining plate.

15. The decorative frame according to claim 14, characterized in that a mouth of the clamping slot (37) is open.

16. The decorative frame according to claim 3, characterized in that: the clipping strips (3) are of structures having two parallel sides (36) and forming a clamping slot (37) between the two sides (36), and the edge of the lining plate (1) is located, in the clamping slot (37), thereby realizing the clamping of the clipping strips and the lining plate.

17. The decorative frame according to claim 16, characterized in that: a mouth of the clamping slot (37) is open.

* * * * *